US006031791A

United States Patent [19]

Thoni

[11] Patent Number: 6,031,791

[45] Date of Patent: Feb. 29, 2000

[54] MONITORING CLOCK

[76] Inventor: DeAnna Thoni, 4826 Briarwood Dr., Nashville, Tenn. 37211

[21] Appl. No.: 08/922,766

[22] Filed: Sep. 3, 1997

[51] Int. Cl.[7] ..... G04B 19/04; G04B 25/00; G04B 19/06

[52] U.S. Cl. ..... 368/80; 368/223; 368/228

[58] Field of Search ..... 368/10, 76, 77, 368/80, 223, 228, 232; 434/304; D10/122–126

[56] References Cited

U.S. PATENT DOCUMENTS

| | | | |
|---|---|---|---|
| D. 146,757 | 5/1947 | Webb . | |
| D. 149,106 | 3/1948 | Berman . | |
| 2,567,497 | 9/1951 | Sorensen . | |
| 2,994,970 | 8/1961 | Spooner . | |
| 3,608,214 | 9/1971 | Bancati . | |
| 3,763,648 | 10/1973 | Pakter et al. | 58/148 |
| 3,967,389 | 7/1976 | Brooks | 35/39 |
| 4,124,945 | 11/1978 | Totten | 35/39 |
| 4,206,592 | 6/1980 | Maue | 368/233 |
| 4,223,801 | 9/1980 | Carlson | 221/3 |

*Primary Examiner*—Vit Miska
*Attorney, Agent, or Firm*—Waddey & Patterson; Edward D. Lanquist, Jr.

[57] ABSTRACT

A clock for facilitating the monitoring of a periodic, cyclical event, such as the orderly turning of bed bound patients. The clock comprises a face, indicia corresponding to the hours of a day, an hour hand and a minute hand operably attached to the face. The indicia corresponding to the hours of the day are coded in some manner, such as by coloring, to establish a plurality of time intervals. A legend is provided to associate the coded time interval to the occurrence of an event or of a particular status corresponding to each respective time interval. In one embodiment, the indicia for the hours of the day may be colored to indicate a given time interval. In an alternate embodiment, the face of the clock may be divided into sectors, each being representative of a time interval. In yet another embodiment, the indicia for the hours of the day may be positioned within an annular ring or band that is divided into segments, each being representative of a time interval.

2 Claims, 3 Drawing Sheets

MONITORING CLOCK

BACKGROUND OF THE INVENTION

The present invention relates generally to clocks and, more particularly to clocks for monitoring periodic events, such as the orderly turning of bedridden patents to prevent pressure ulcers.

Pressure ulcers, more commonly known as bedsores, are a preventable cause of increased morbidity, mortality and medical costs among bed bound patients. Research indicates that as many as fourteen percent (14%) of all hospitalized patients develop pressure ulcers, and they are particularly prevalent among institutionalized elderly bed bound patients. The cost of pressure ulcer treatment ranges from $2,000 to $30,000 per case, which translates into over $3.5 billion per year in additional medical costs.

Pressure ulcers are caused by the compression of soft tissue between bony prominences and an external surface such as a chair or mattress. When a patient remains in one position for an extended period of time, the pressure obstructs the flow of blood, causing ischemia and tissue death. Pressure ulcers can occur in one to six hours and pressure relief is the only effective means of prevention. The U.S. Department of Health and Human Services, Agency for Health Care Policy and Research recommends that bed bound patients be repositioned every two hours to relieve pressure and prevent pressure ulcers.

The standard practice among most health care providers is to reposition the patient every two hours, rotating from spine to lying on either the left side or the right side. Clinical documentation supports this method for preventing the occurrence of pressure ulcers. The ideal prevention plan has the patient spending only two hours in a given position. To accomplish the two-hour repositioning of patients, health care providers must keep track of the time that a patient is turned and the specific position to which the patient was moved. Repositioning events are commonly recorded on a written turning schedule. Unfortunately, such recordation requires additional time and paperwork for health care providers. Furthermore, such monitoring is prone to errors and is complicated by the changes in personnel that occur during a twenty-four hour period. Thus, the repositioning of bed bound patients is often dependent upon the diligence of health care providers in monitoring and recording such repositioning events.

It will be appreciated by those skilled in the art that it is desirable to have a means for accurately monitoring periodic events, such as the orderly turning of bed bound patients in order prevent pressure ulcers. Accordingly, the clock of the present invention eliminates the need for a written turning schedule. Healthcare providers can quickly determine the appropriate position for a patient merely by observing the clock and associating the time with a given patient position. Furthermore, the use of the clock of the present invention provides a means for maintaining continuity in the administration of care among the different health care providers that typically attend a patient within a given twenty-four hour period. Finally, the clock of the present invention requires minimal training for health care staff. Thus, it is believed that use of the clock of the present invention will result in an increase in caregiver and patient compliance.

There are several clocks found in the art in which the face of the clock is coded, such as with color. However, all of these devices are directed to aids for teaching a person how to tell time.

For example, U.S. Pat. No. 3,608,214, issued to Rancati, which is incorporated by reference as if fully set forth herein, is directed to a device and method for teaching the reading of time. The device includes a clock fact wherein the numeral indicia differ from each other in a manner other than shape, and wherein there is provided a plurality of sets of indicators with each set of indicators differing from the other sets in the same manner as the indicia differ from each other. Thus, the sets of indicators each relate to a different indicia on the clock face respectively by color and/or texture. Initially, the passage of time is indicated by selectively applying a given set of indicators preferably shaped as sectors of the clock face successively to the clock face between successive indicia; the sectors corresponding to a given one of the indicia or numerals on the clock face.

U.S. Pat. No. 3,967,389, issued to Brooks, which is incorporated by reference as if fully set forth herein, is directed to a time telling teaching aid comprising a base, a rotatable peripheral wing with selector window, a top surface that represents the face of a clock, and a minute hand whose point is linked to the rotatable peripheral ring at the selector window and hour hand that individually rotate about a common pivot. The device uses a color and script coding ring and a separate color matching system for two distinct time telling functions.

U.S. Pat. No. 4,124,945, issued to Totten, which is incorporated by reference as if fully set forth herein, is directed to a time telling teaching device in the form of a color coordinated clock face provided with two numerical scales circumferentially and concentrically disposed thereon in spaced relationship to represent segments of time corresponding to the face of a clock. The inner scale represents the hour numerals 1 to 12, which are color coordinated to correspond to their respective 30 degree arc segments. The outer scale represents the minute numerals 00 to 55 in intervals of five. The device further includes hour and minute hands pivotally mounted on the clock face centrally of the numerical scales. The hour hand is of such a size as to lie within the colored arc segments, and the minute hand is of such length as to extend beyond the colored arc segments and up to the outer numerical scale.

All of the aforementioned devices incorporate color coding to facilitate teaching a person how to tell time. None is configured to enable a person, such as a healthcare practitioner, to monitor a periodic event, such as the orderly turning of bed bound patients. What is needed then, is a clock that is coded and/or configured to facilitate such monitoring.

SUMMARY OF THE INVENTION

The present invention is directed to a clock incorporating coding and a legend for monitoring and indicating a periodic event, such as when a bed bound patient needs to be turned or repositioned. The clock includes a face having at least one set of indicia positioned radially about the face for indicating the hours of a day. The indicia preferably comprises the arabic numerals 1 to 12; however, it is also contemplated that the indicia may comprise other symbols for indicating hourly increments. An hour hand and a minute hand are rotably attached to the face of the clock at a center point thereof, and extend a length therefrom sufficient to indicate the time of day.

The indicia for indicating the hours of the day may be color coded to establish a plurality of time intervals, such as 1-hour intervals, 2-hour intervals, etc. For example, the indicia for the one o'clock and two o'clock hours may be one color, the indicia for the three o'clock and four o'clock hours may be a different color, the indicia for the five o'clock and six o'clock hours may be yet another color, and so forth, thus creating a series of two hours intervals. The clock further includes a legend for indicating the event associated with a given color.

In an alternate embodiment, the face of the clock is divided into colored sectors, each of which is indicative of a given time interval. In yet another embodiment, the indicia for the hours of the day are positioned within an annular ring or band, which is divided into segments representative of time intervals.

Thus, it is an object of the present invention to provide a clock having indicia for facilitating the monitoring of periodic, repetitive events, such as the orderly turning of bed bound patients.

It is another object of the present invention to provide a clock for monitoring such events which comprises a face having indicia corresponding to the hours of a day, wherein the indicia is color coded to indicate a given event or status, such as the position for the patient.

These and other objects, features, and advantages shall become apparent after consideration of the description and drawings set forth herein. All such objects, features, and advantages, are contemplated to be within the scope of the present invention even though not specifically set forth herein.

DESCRIPTION OF THE PREFERRED EMBODIMENTS

Figure 1:
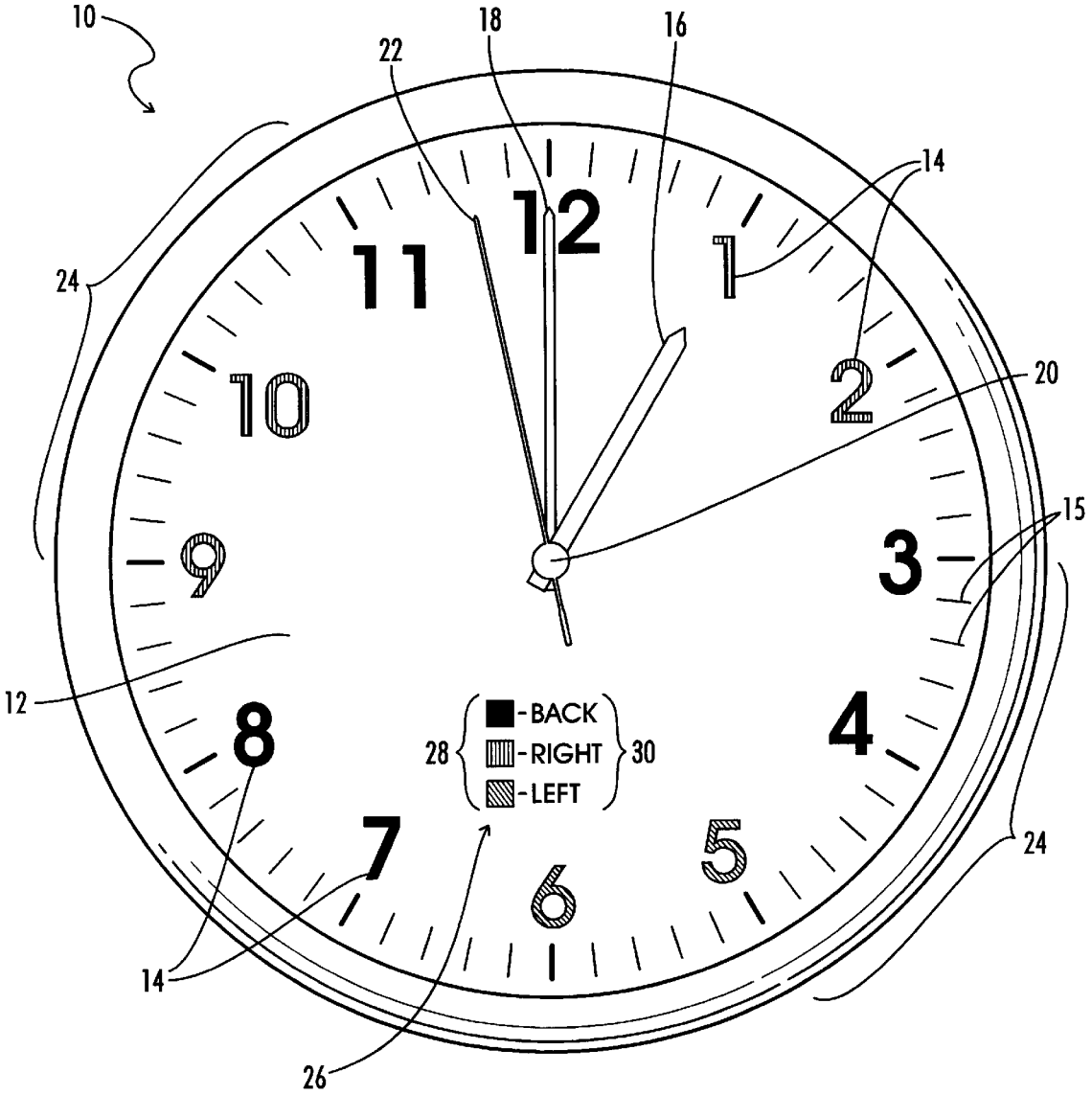
FIG. 1 is a front view of an embodiment of the present invention.

An embodiment of the present invention is designated generally by the reference numeral 10 in FIG. 1. Clock 10 includes a face 12 having indicia 14 thereon for indicating the hour of a day. The clock 10 may further include indicia 15 for indicating the minutes in an hour. The indicia 14 preferably comprises a set of arabic numerals including consecutive integers one through twelve. However, it is also contemplated that the indicia 14 may comprise roman numerals or other symbols for indicating the hours of the day. The indicia 14 is preferably positioned radially about the face 12 in a clockwise spaced relationship to indicate intervals of time as on a conventional clock. An hour hand 16 and a minute hand 18 are rotatably attached to the face 12 at a center point 20, and extend therefrom a length sufficient to indicate the time of day upon visual observation. The clock 10 may also include a second hand 22.

In the preferred embodiment, the indicia 14 representing the hours of the day are color coded to establish a plurality of time intervals 24, such as one-hour intervals, two-hour intervals, three-hour intervals and so forth. Accordingly, the indicia 14 for the hours included in each time interval 24 is colored to correspond to a periodic event. In this manner, the indicia 14 for the two-hour time interval between one o'clock and three o'clock, i.e. the numerals "1" and "2", are colored a first color; the indicia for the two-hour time interval between three o'clock and five o'clock, i.e. the numerals "3" and "4", are colored a second color, and so forth.

In the preferred embodiment, the clock 10 of present invention further includes a legend 26 including color indicia 28 corresponding to the color coding of the indicia 14 for the hours of the day, and position indicia 30 for indicating a given patient position. For example, the position indicia 30 may include terms such as "back", "right" and "left" to indicate the position of the patient's body. Thus, "back" indicates that the patient is to be positioned on his/her back. "Right" indicates that the patient is to be positioned on his/her right side. "Left" indicates that the patient is to be positioned on his/her left side.

Figure 2:
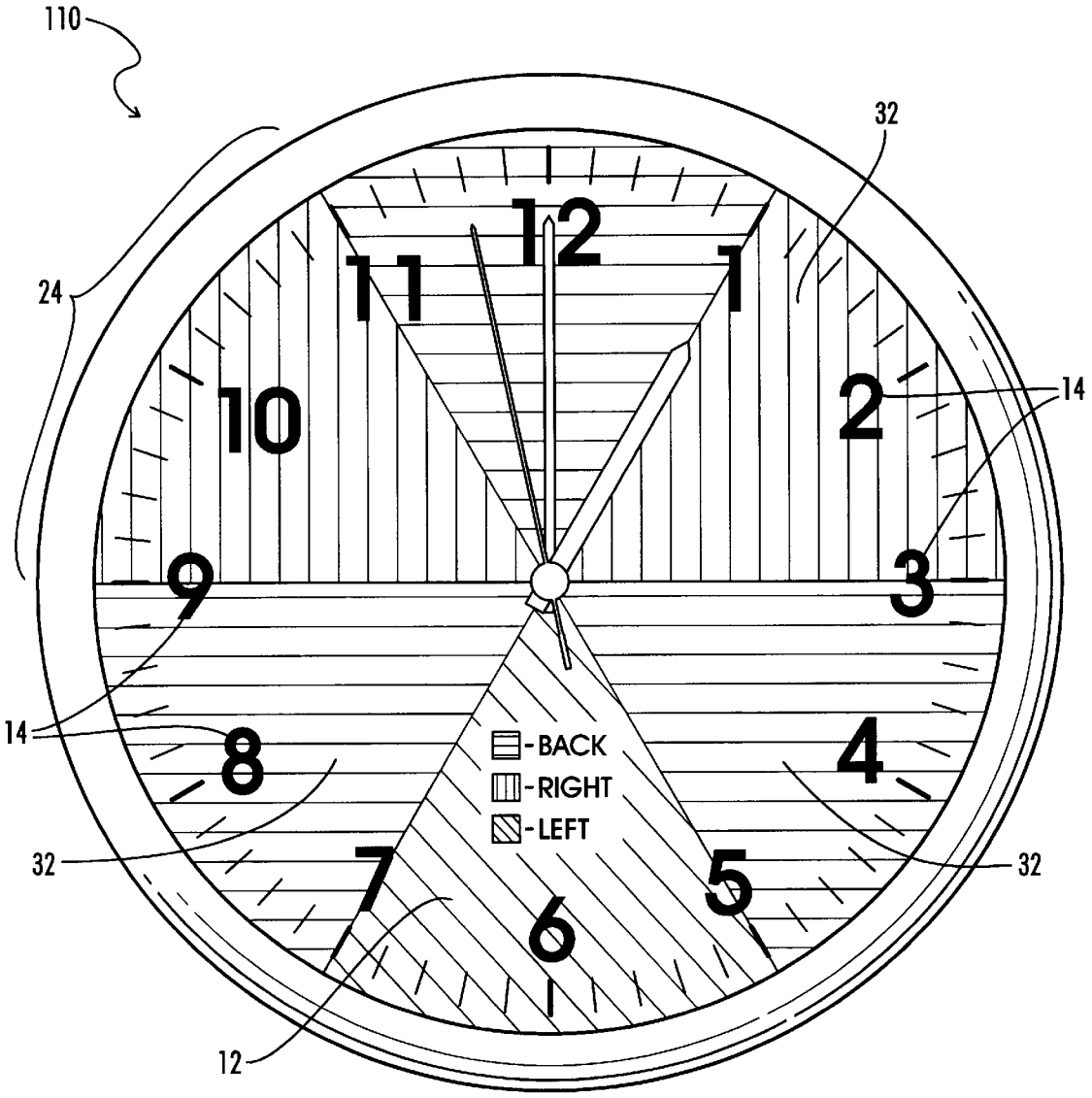
FIG. 2 is a front view of an alternate embodiment of the present invention.

In an alternate embodiment designated generally by the reference numeral 110 in FIG. 2, the face 12 may be divided into color-coded sectors 32 for indicating the desired time intervals 24. Thus, rather than color coding the indicia 14 representative of a time interval 24, the arc sector 32 containing the indicia 14 for that time interval 24 may be color coded. For example, the sector 32 representative of the two-hour time interval between one o'clock is colored a first color, the sector 32 representative of the two-hour time interval between three o'clock and five o'clock is colored a second color, and so forth.

Figure 3:
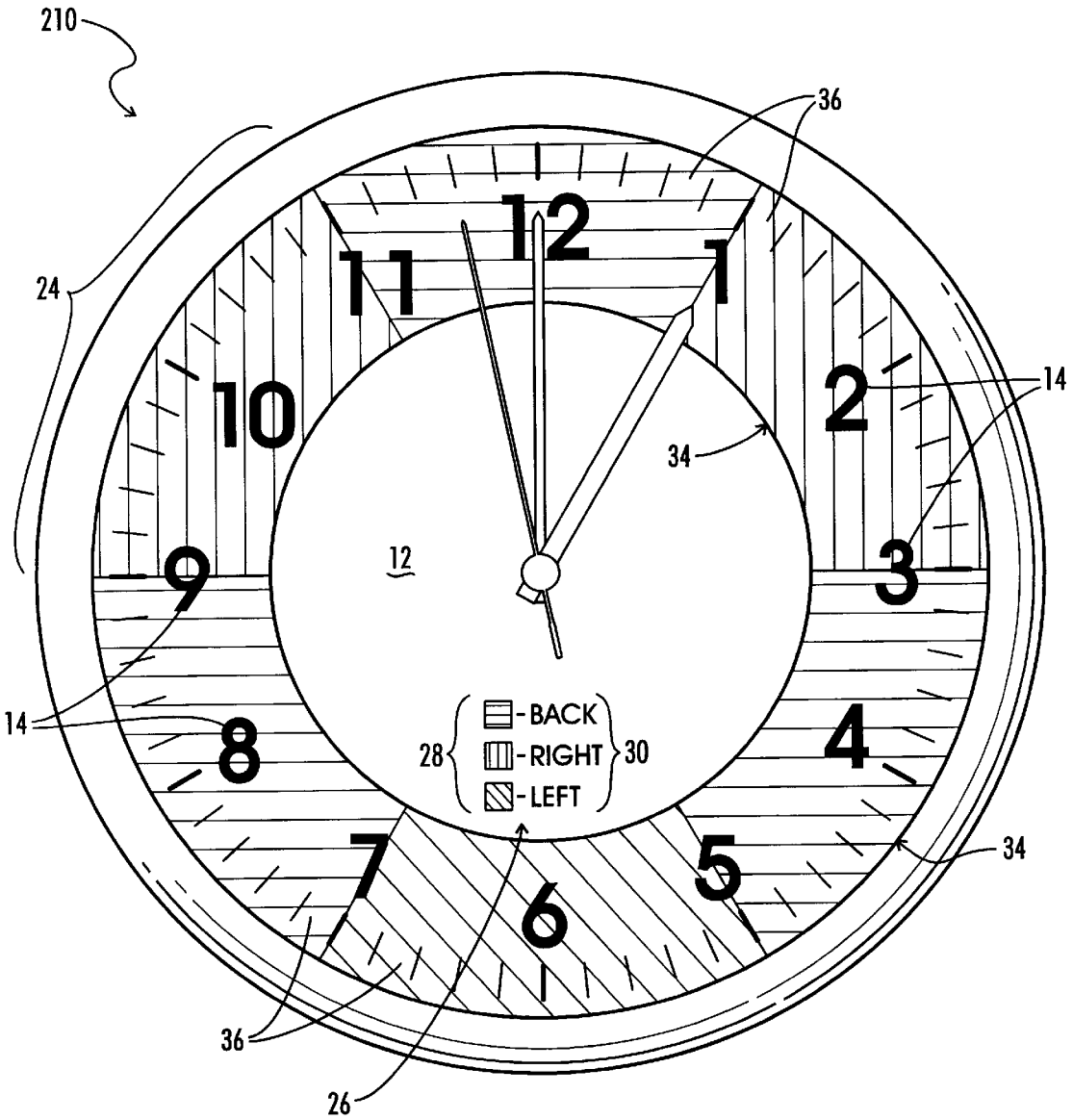
FIG. 3 is a front view of an alternate embodiment of the present invention.

In an alternate embodiment designated generally by the reference numeral 210 in FIG. 3, the indicia 14 for the hours of the day may be positioned within an annular ring or band 34 divided into segments 36, each of which is representative of a time interval 24. The segments 36 may each be color-coded in accordance with a periodic event as set forth in the legend 26.

The time intervals 24 described herein are intended to be representative only and are not intended to be limiting. Thus, the time intervals 24 may include any number of hours of the day, in any arrangement.

MODE OF OPERATION

In accordance with the present invention, the indicia 14 representing the hours of the day, the sectors 32 or the segments 36 may be coded to indicate the hours included in a given time interval 24. In the preferred embodiment, the coding comprises coloring the indicia 14, the sectors 32 or the segments 36 a color that is different than the color associated with the adjacent time interval 24. The color associated with the indicia 14, sector 32 or segment 36 of one time interval 24 may be the same color associated with the indicia 14, sector 32 or segment 36 of another time interval 24, so long as adjacent indicia 14, sectors 32 or segments 36 are colored differently to distinguish separate time intervals 24.

By way of example, the user may desire to establish two-hour intervals, beginning with one o'clock. Accordingly, indicia 14, sector 32 or segment 36 associated with the two-hour interval from one o'clock up to three o'clock, i.e. the numerals "1" and "2", would be colored one color, such as red. The next two-hour interval from three o'clock up to five o'clock, i.e. the numerals "3" and "4", would be colored a second color, such as black. The next two-hour interval from five o'clock up to seven o'clock, i.e. the numerals "5" and "6", would either be colored a third color, such as green, or the first color (red).

The legend 26 indicates an event, such as the position of a patient, which is to occur during the time interval 24 associated with a given color. For example, with reference to FIG. 3, the user can observe that a patient is to be positioned on his/her right side from one o'clock up to three o'clock and from nine o'clock up to eleven o'clock because the color red indicates this position and corresponds to these time intervals. Similarly, the patient is to be positioned on his/her back from three o'clock up to five o'clock, from seven o'clock up to nine o'clock and from eleven o'clock up to one o'clock because the color black indicates this position and corresponds to these time intervals. Finally, the patient is to be positioned on his/her left side from five o'clock up to seven o'clock because the color green indicates this position and corresponds to this time interval.

In this manner, healthcare providers turn bed bound patients in an orderly fashion and, thus, prevent or minimize the development of pressure ulcers merely by observing the time and associating the color for that time with the position indicated on the legend. As set forth hereinabove, the clock of the present invention may include any desired time interval. Furthermore, the present invention may be used in a variety of applications which include sequenced, cyclical or repetitive events.

Thus, although there have been described particular embodiments of the present invention of a new and useful clock for monitoring periodic events, such as the turning of patients, it is not intended that such references be construed as limitations upon the scope of this invention except as set forth in the following claims.

What is claimed is:

1. A monitoring clock, comprising:

a face;

an hour hand and a minute hand operably attached to the face;

means for driving the hour hand and the minute hand;

segments on the face for indicating the position of a patient during a time interval indicia representative of the hours of a day, wherein the indicia is positioned in spaced relationship on the face and the segments are coded to establish a plurality of time intervals; and a legend for associating the coding of the plurality of time intervals with the position of the patient.

2. A monitoring clock, comprising:

face;

an hour hand and a minute hand operably attached to the face;

means for driving the hour hand and the minute hand;

indicia representative of the hours of a day positioned in spaced relationship on the face;

wherein the face is divided into a plurality of sectors that are coded to establish a plurality of time intervals wherein the coded sectors represent the position of a patient; and a legend for associating the coding of each of the plurality of time intervals with the position of a patient.

* * * * *